US009518371B2

(12) United States Patent
Wang et al.

(10) Patent No.: US 9,518,371 B2
(45) Date of Patent: Dec. 13, 2016

(54) METHOD FOR IMPROVING EXCAVATING OPERATION CHARACTERISTIC AND GRADING OPERATION CHARACTERISTIC OF EXCAVATOR

(71) Applicant: XCMG EXCAVATOR MACHINERY CO., LTD, Xuzhou (CN)

(72) Inventors: Yong Wang, Xuzhou (CN); Hong Zhang, Xuzhou (CN); Shengxia Zhang, Xuzhou (CN); Kai Liu, Xuzhou (CN); Zong Li, Xuzhou (CN); Jian Zhang, Xuzhou (CN); Mingjun Liao, Xuzhou (CN); Jiasheng Qin, Xuzhou (CN); Yufeng Yang, Xuzhou (CN)

(73) Assignee: XCMG EXCAVATOR MACHINERY CO., LTD, Xuzhou (CN)

( * ) Notice: Subject to any disclaimer, the term of this patent is extended or adjusted under 35 U.S.C. 154(b) by 682 days.

(21) Appl. No.: 13/933,395

(22) Filed: Jul. 2, 2013

(65) Prior Publication Data

US 2014/0007942 A1 Jan. 9, 2014

(30) Foreign Application Priority Data

Jan. 11, 2011 (CN) ..... 2011 1 0003932

(51) Int. Cl.

| | |
|---|---|
| ***F15B 11/17*** | (2006.01) |
| ***E02F 3/84*** | (2006.01) |
| ***E02F 9/22*** | (2006.01) |
| ***E02F 3/43*** | (2006.01) |

(52) U.S. Cl.

CPC ..... *E02F 3/844* (2013.01); *E02F 3/435* (2013.01); *E02F 9/2242* (2013.01);

(58) Field of Classification Search

USPC .... 137/1, 565.29, 625; 91/520; 60/421, 394, 60/484

See application file for complete search history.

(58) Field of Classification Search

CPC ..... E02F 3/433; E02F 3/432; E02F 3/43; E02F 9/2239; E02F 3/844; E02F 9/2292; E02F 9/2285; F15B 11/17

*E02F 9/2282* (2013.01); *E02F 9/2285* (2013.01); *E02F 9/2292* (2013.01); *E02F 9/2296* (2013.01); *F15B 11/17* (2013.01); *F15B 2211/20546* (2013.01); *F15B 2211/20576* (2013.01); *F15B 2211/3116* (2013.01); *F15B 2211/329* (2013.01); *Y10T 137/0318* (2015.04)

(56) References Cited

U.S. PATENT DOCUMENTS 3,073,123 A * 1/1963 Hodgson ..... F16H 61/40 60/424

4,875,337 A * 10/1989 Sugiyama ..... E02F 9/2239 414/699

(Continued)

*Primary Examiner* — F. Daniel Lopez
*Assistant Examiner* — Richard Drake

(57) ABSTRACT

A method for improving excavating operation characteristic and grading operation characteristic of an excavator is disclosed. A hydraulically controlled selector valve is added in a boom confluence control circuit of a hydraulic excavator, and a solenoid valve group is added in the boom confluence control circuit and the bucket/stick confluence control circuit. A controller sends a control signal to switch the solenoid valve group between a disconnected mode and a connected mode. The controller may send out a signal to disconnect the solenoid valve group, to restore a valve spool to a middle position, to restore a boom lifting confluence circuit, and to disconnect a bucket/stick swinging confluence circuit to perform a standard excavation mode. The controller may send out a signal to connect the solenoid valve group to disconnect a boom lifting confluence circuit and to increase a bucket/stick swinging confluence circuit to achieve a grading operation mode.

12 Claims, 5 Drawing Sheets

(56) References Cited

U.S. PATENT DOCUMENTS 6,050,090 A * 4/2000 Tohji ..... E02F 9/2203 60/421
6,543,223 B2 * 4/2003 Muschong ..... B25B 5/061 60/476
6,582,340 B1 * 6/2003 Arie ..... B60K 25/02 477/111
7,059,125 B2 * 6/2006 Oka ..... E02F 9/2235 60/422
7,178,333 B2 * 2/2007 Oka ..... E02F 9/2239 60/421
7,356,991 B2 * 4/2008 Kim ..... E02F 9/2282 60/421
7,743,611 B2 * 6/2010 Horii ..... E02F 9/2239 60/421
8,167,154 B2 * 5/2012 Heidrich ..... B66D 1/44 212/284
8,387,376 B2 * 3/2013 Son ..... F15B 11/17 60/394

* cited by examiner

METHOD FOR IMPROVING EXCAVATING OPERATION CHARACTERISTIC AND GRADING OPERATION CHARACTERISTIC OF EXCAVATOR

CROSS-REFERENCES TO RELATED APPLICATIONS

This application claims the priority to International Application No. PCT/CN2012/070199, filed on Jan. 10, 2012, which claims priority to Chinese Patent Application No. 201110003932.8, filed on Jan. 11, 2011, the entire contents of all of which are incorporated herein by reference.

FIELD OF THE DISCLOSURE

The present disclosure relates to the field of hydraulic circuit apparatus technology including an excavator operation control method and, more particularly, relates to a method for improving excavating operation characteristic and grading operation characteristic of an excavator.

BACKGROUND

A hydraulic excavator is currently widely used in occasions of building constructions such as housing foundation excavation and backfilling, pipeline laying and farmland water resource construction. An excavator has advantages in allowing flexible construction and having high execution efficiency. A hydraulic excavator is mainly configured by components such as a work device, a rotation mechanism, a travel mechanism, a rotating platform, and a hydraulic control device. Lifting and lowering of a boom, extending and contracting of a stick, rotating of a bucket and rotating of a rotary device are all realized by the control device to control a multiplexer valve group to allocate hydraulic oil supplied to hydraulic pumps via a hydraulic circuit. An excavating operation at a construction site usually involves a combination of a long-time excavating operation and a land grading operation. Therefore, under the premise of not affecting operation efficiency, both excavating operation characteristic and grading operation characteristic of an excavator are highly demanded by an operator.

The so-called excavating operation characteristic refers to a comprehensive judgment regarding stability, smoothness, and maneuver responsiveness of an excavator during an excavating operation. Among these, the smoothness and the maneuver responsiveness of the excavating operation are of most concern to an operator. A reasonable ratio of movement speeds of a boom cylinder and a stick cylinder of an excavator directly determines the excavating operation characteristic of the excavator and directly affects use efficiency of the excavator and operation experience of the operator. Best matching of cylinder movement speeds is achieved by controlling the openings/closings and a degree of opening of a valve spool of a hydraulic control valve via pilot oil of a hydraulic control system of the excavator. A valve corresponding to the valve spool is opened to connect to an oil passage of a main pump. Controlling over extension and contraction and a speed of a cylinder movement are achieved by connecting oil passages and by controlling flow rates of the oil passages.

During an excavating operation of a conventional excavator, a work device has a large acceleration. A sudden stop at a high speed or a sudden start is often accompanied with large shaking and rocking of the whole excavator, which affects comfortability and smoothness of an excavating operation of an excavator and increases tiredness of an operator and thus affects operation efficiency. Lifetime of an excavator operating under such a condition is reduced. Further, frequent switching of a hydraulic pump between no-load and high-load states increases engine load. Fuel consumption and operating costs both increase.

Grading operation characteristic of an excavator is an important use characteristic after the excavating operation characteristic, and is mainly used in the following work conditions: excavating a trench for pipe laying; land grading, slope repairing, and the like. In a conventional technology, the grading operation characteristic of an excavator can be directly linked to design parameters of the excavator. Once a product design is completed, movement speeds of a boom cylinder, a stick cylinder and a bucket cylinder are fixed. Therefore, during a land grading operation, the movement speed of the boom, stick and bucket is a constant parameter. A conventional excavator has the following problems during a land grading operation: Boom lifting is too fast; reciprocating speed of a stick is poor; and the bucket speed is not coordinated and synchronized with a combined movement of the boom and the stick. Thus, performance of a grading operation is directly affected.

During a grading operation, a main reason for slow lifting of a boom is that, in a conventional design, an oil supply method of using double pump confluence is adopted for increase excavating speed of a bucket. In double pump oil supply, oil is simultaneously supplied to a boom cylinder, a stick cylinder and a bucket cylinder. When an excavator performs a lifting operation during excavating or trenching, since a large amount of hydraulic oil is lost too early due to confluence of the bucket cylinder, amount of hydraulic oil supplied to the boom cylinder is reduced, causing uncoordinated moving speeds. In fact, directly adding a corresponding flow control valve in a circuit of the boom cylinder, the stick cylinder and the bucket cylinder can also adjust to some extent a combined operation effect of an executing element to alleviate a speed mismatch problem. However, because a size of a flow-control orifice is hard to be reasonably determined, effects obtained by adopting this method do not provide generalized significance. In addition, this method increases complexities and difficulties in pipeline design and adjustment, and occupies the limited control pipeline of a control valve.

BRIEF SUMMARY OF THE DISCLOSURE

Technical Solutions

To solve the above-described problems in conventional technologies, the present disclosure provides a method for improving the excavating operation characteristic and grading operation characteristic of an excavator. By improving a control method, comfortability during excavating operation and grading operation is improved without causing negative effect on operation efficiency.

To achieve the above object, the present disclosure provides a method for improving excavating operation characteristic and grading operation characteristic of an excavator. In this method, a hydraulically controlled selector valve is added to a control circuit controlling boom confluence in a hydraulic excavator. A solenoid valve group is added to a boom confluence control circuit and a stick confluence control circuit. A controller sends out a control signal to perform switching between a disconnected mode and a connected mode of the solenoid valve group. The controller sends out a signal to disconnect the solenoid valve group, restore a valve spool to a middle position, restore a boom lifting confluence circuit, and disconnect a stick swinging confluence circuit to achieve a standard excavation mode. The controller sends out a signal to connect the solenoid valve group. The solenoid valve group disconnects a boom lifting confluence circuit and increases a stick swinging confluence circuit to achieve a grading operation mode.

In the standard excavation mode, a pressure sensing end of the hydraulically controlled selector valve detects a control pressure signal of stick excavation. When a control pressure value of the stick excavation is smaller than a change-direction pressure of the hydraulically controlled selector valve, the hydraulically controlled selector valve does not change direction. Hydraulic oil of a pilot control oil passage controlling a boom cylinder and a stick cylinder is entirely supplied by a double pump after confluence. When the control pressure value of the stick excavation reaches the change-direction pressure of the hydraulically controlled selector valve, the hydraulically controlled selector valve changes direction. A boom confluence control circuit is disconnected and oil is independently supplied to a boom by a single pump, while a stick excavation double pump confluence circuit is maintained.

In the grading operation mode, an electrical signal controlling end of the solenoid valve group is connected with the controller. The controller sends out a change-direction command to the solenoid valve group. After receiving the command, the solenoid valve group changes direction. A pilot control oil passage changes allocation of a double pump confluence. A confluence control circuit of boom lifting hydraulic oil is disconnected and is replaced by using a single pump to supply oil. Stick excavation maintains double pump confluence, and a hydraulic oil passage of stick swinging is increased to double pump confluence.

The change-direction pressure of the hydraulically controlled selector valve is adjusted by a pressure adjustment spring inside the valve.

Operation Principle

Based on the conventional technology, a set of pressure-adjustable hydraulically controlled selector valves is added. Connection and disconnection of a corresponding control circuit is controlled by varying change-direction of the hydraulically controlled selector valve, thereby changing a changeless confluence oil supply mode in the conventional technology. By changing the confluence mode, reasonable allocation of a flow of a main pump is realized. Thereby, utilization efficiency of the flow of the main pump during stick excavation is improved, and power utilization efficiency of an engine is improved. By selectively connect and disconnect boom confluence, hydraulic impact during boom lifting is reduced, thereby improving operator comfortability during operation. An operator can intentionally select between an excavating operation mode and grading operation mode. The solenoid valve group is controlled to change a confluence control circuit to selectively enhance a fast reciprocating movement function of a stick that is required in a grading operation while reducing hydraulic flow in a boom lifting circuit. This reduces a hydraulic impact, improves comfortability during a grading operation, and achieves the best land grading effect at a lowest level of complexity.

Industrial Applicability and Advantageous Effects

Beneficial effects of the present disclosure include the following. In the excavating operation and the grading operation, various actions can be coordinated and synchronized. Utilization efficiency and operational comfortability of the excavator can be improved while reducing production and maintenance cost and significantly improving operation efficiency.

It is to be understood that both the foregoing general description and the following detailed description are exemplary and explanatory only and are not restrictive of the disclosure, as claimed. Other aspects of the present disclosure can be understood by those skilled in the art in light of the description, the claims, and the drawings of the present disclosure.

REFERENCE SIGN LIST

Figure 1:
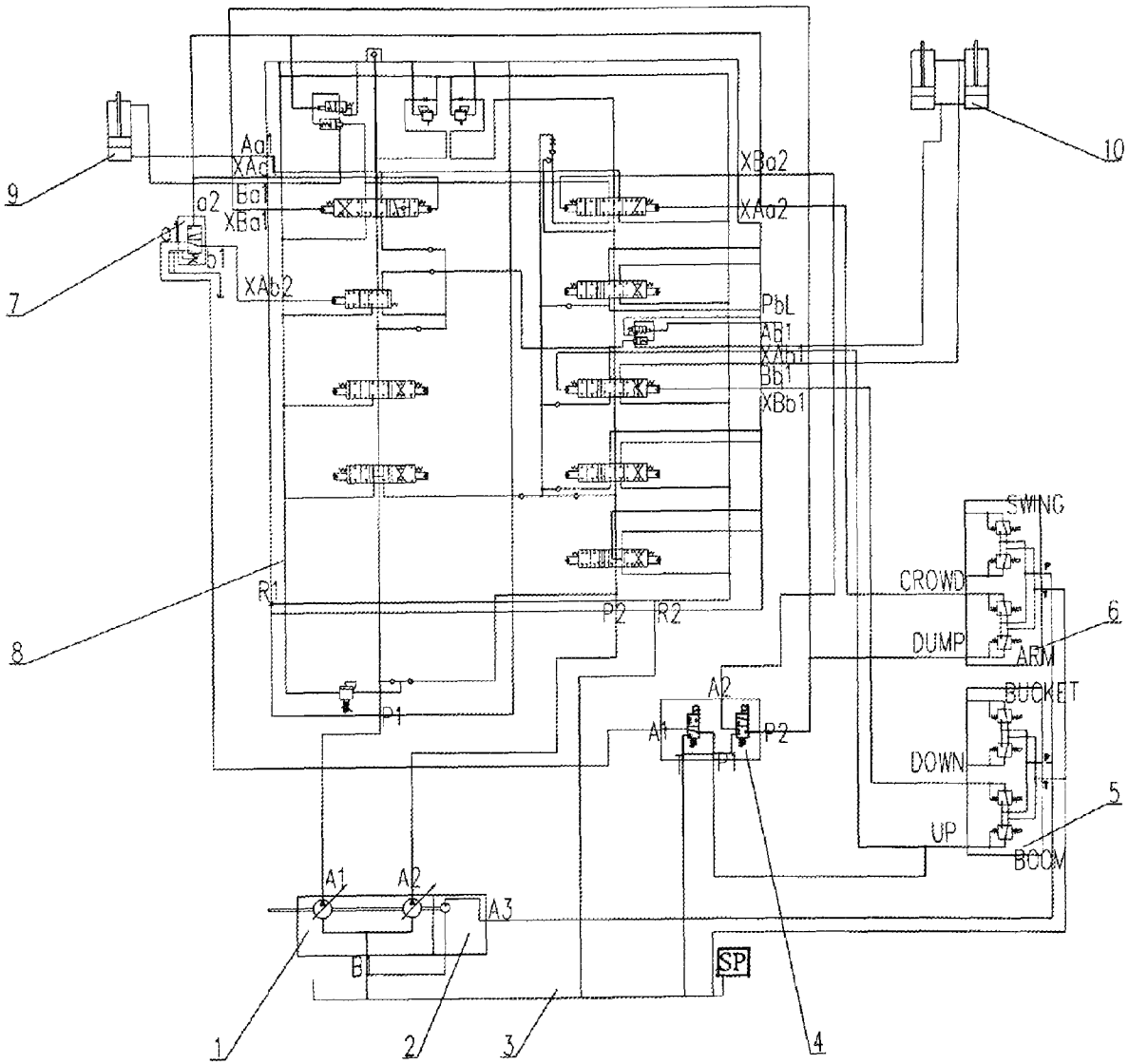
FIG. 1 is a schematic diagram illustrating a hydraulic process in accordance with various disclosed embodiments.

Double hydraulic pump 1
Gear pump 2
Hydraulic oil tank 3
Solenoid valve group 4
Right control lever valve 5
Left control lever valve 6
Hydraulically controlled selector valve 7
Multiplexer valve group 8
Stick cylinder 9
Boom cylinder 10

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 2:
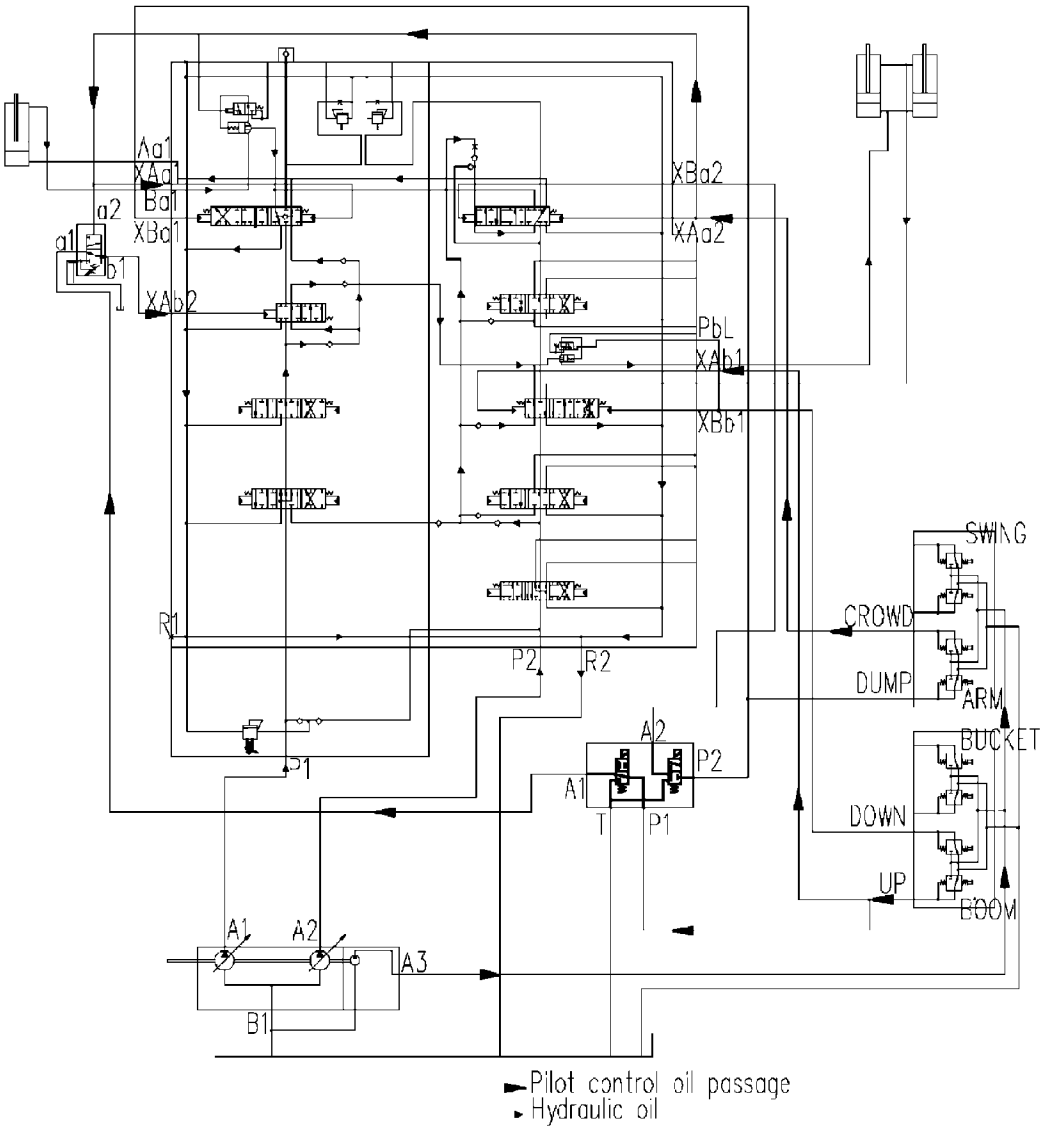
FIG. 2 is schematic diagram illustrating flow directions of hydraulic oil passages in a standard excavation mode when a hydraulically controlled selector valve does not change direction in accordance with various disclosed embodiments.
Figure 3:
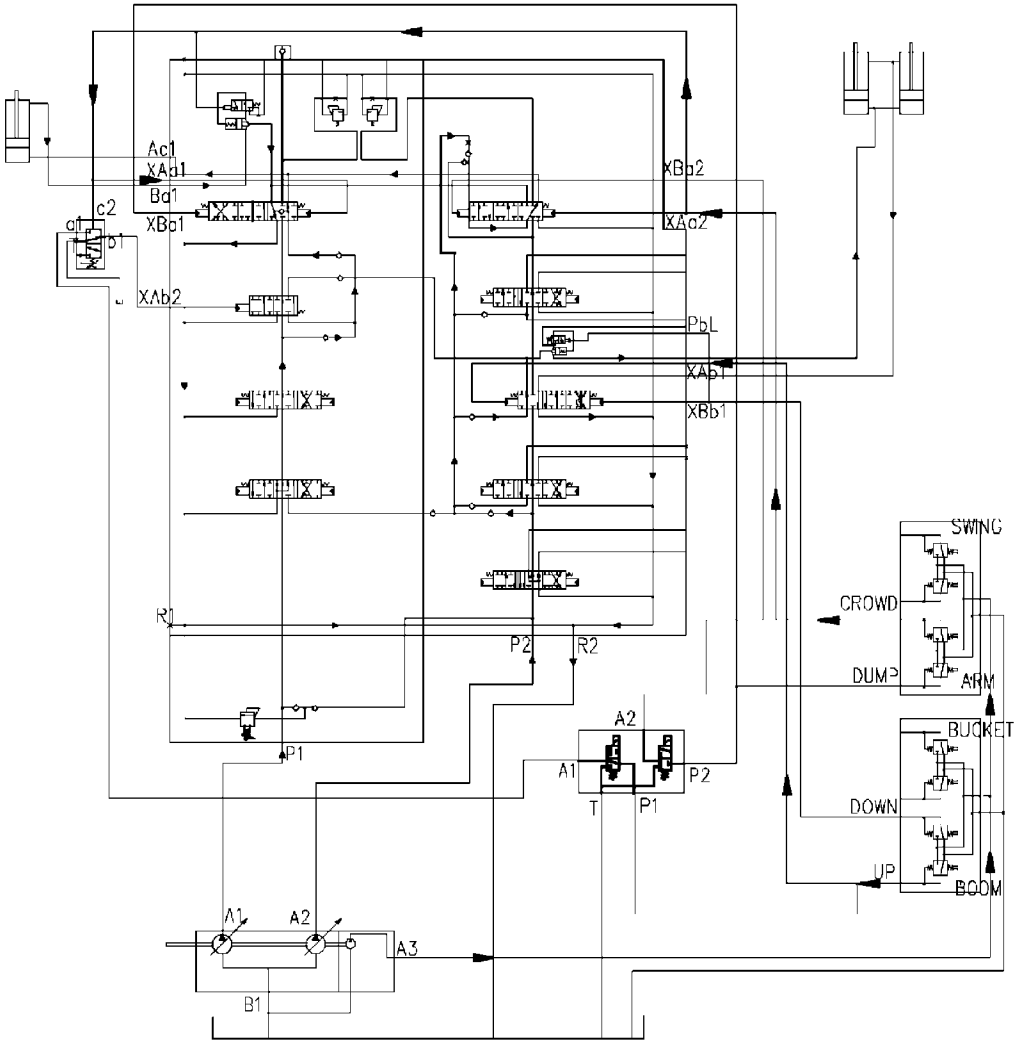
FIG. 3 is schematic diagram illustrating flow directions of hydraulic oil passages in a standard excavation mode when the hydraulically controlled selector valve changes direction in accordance with various disclosed embodiments.

In a first embodiment, as illustrated in FIGS. 1, 2 and 3, in a "standard excavation mode," when a hydraulically controlled selector valve 7 does not change a direction, an operator controls a right control lever valve 5 to cause a boom lifting pilot control circuit to be connected. Hydraulic oil enters a right control lever valve 5 from a hydraulic oil tank 3 via a gear pump 2 and control oil that is supplied to a solenoid valve group 4 enters end P1 via a BOOM UP end. In this case, a P1 oil passage and a control oil output end A1 of the solenoid valve group 4 are in a, connected state.

Pilot oil flows into a control oil input end a1 of the hydraulically controlled selector valve 7 via a control oil output end A1. At this point, the hydraulically controlled selector valve 7 does not reach a pressure condition that is required for changing a direction. Therefore, the control oil input end a1 and a control oil output end b1 of the hydraulically controlled selector valve 7 are connected.

The pilot oil pushes a valve spool of a multiplexer valve group 8 to change direction. P1 hydraulic oil of a double hydraulic pump 1 is involved in a boom lifting confluence. Control oil of another channel that is input via the BOOM UP end is connected with a control end XAb1 of the multiplexer valve group 8. After the valve spool changes direction, P2 hydraulic oil of the double hydraulic pump 1 merges with P1 hydraulic oil to achieve boom lifting (boom cylinder 10 extends out). Hydraulic oil in a rod chamber of the boom cylinder 10 flows back via the multiplexer valve group 8 and, thereafter, returns to the hydraulic oil tank 3 via an oil return port R2, forming a complete boom lifting operation circuit.

A left control lever valve 6 is controlled to cause a stick excavation pilot control circuit to be connected. Control oil entering the left control lever valve 6 via the gear pump 2 is connected to a pilot control end XAa2 of the multiplexer valve group 8 via an ARM CROWD end to cause a remaining flow of the P2 hydraulic oil of the double hydraulic pump 1 to be supplied to a stick excavation operation (stick cylinder 9 extends out). Control oil of the left control lever valve 6 of another channel is connected to a pilot control end XAa1 of the multiplexer valve group 8 via the ARM CROWD end and pushes the valve spool in the multiplexer valve group 8 to change direction to cause a remaining flow of the P1 hydraulic oil of the double hydraulic pump 1 to participate in the stick excavation operation.

A portion of hydraulic oil in a rod chamber of the stick cylinder 9 participates in confluence of the P1 hydraulic oil and the P2 hydraulic oil via a 'hydraulic oil recovery circuit' in the multiplexer valve group 8 and another portion returns to the hydraulic oil tank 3 via an oil return channel in the multiplexer valve group 8. Thereby, a complete stick excavation operation circuit is formed.

When pressure supplied from the ARM CROWD end of the left control lever valve 6 to the pressure sensing end a2 of the hydraulically controlled selector valve 7 has reached a certain value (that is, when a swing angle of a handle of the left control lever valve 6 has reached a certain angle), the hydraulically controlled selector valve 7 changes direction. The pilot control oil passage that previously connects to the hydraulically controlled selector valve 7 from a control oil output end A1 of the solenoid valve group 4 is disconnected.

A control end XAb2 of the multiplexer valve group 8 connects to the hydraulic oil tank 3 via the hydraulically controlled selector valve 7. The valve spool returns back to a middle position state. A boom confluence hydraulic oil passage supplied by the P1 hydraulic oil of the double hydraulic pump 1 is disconnected. Instead, the P2 hydraulic oil independently supplies the boom lifting. In this case, the P1 hydraulic oil of the double hydraulic pump 1 independently supplies the stick excavation operation and at the same time merges with the P2 hydraulic oil. In this state, the flow of the stick excavation hydraulic oil circuit is larger than the flow of the boom lifting circuit. Therefore, the stick excavation speed is relatively fast; the boom lifting is relatively smooth; hydraulic impact of the work device is reduced; and operation comfortability is improved.

When the operator feels that the excavation state ends and the pressure supplied by the ARM CROWD end of the left control lever valve 6 to the pressure sensing end a2 of the hydraulically controlled selector valve 7 is lower than the pressure for direction changing, the hydraulically controlled selector valve 7 is restored to a middle position state; the hydraulic oil passage is restored to the "standard excavation mode" illustrated in FIG. 2; boom lifting confluence is restored; boom lifting is accelerated; and work efficiency is improved.

Figure 4:
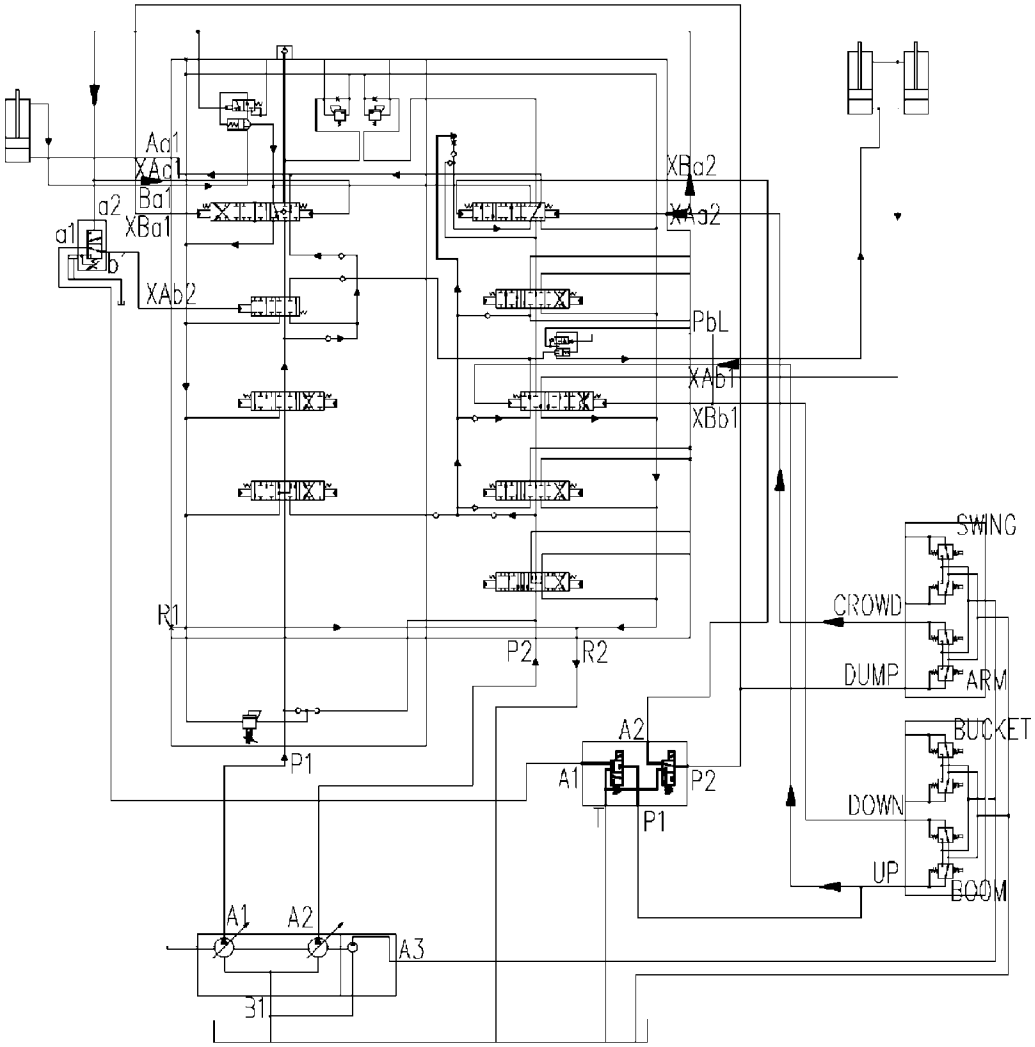
FIG. 4 is a schematic diagram illustrating flow directions of hydraulic oil passages in a grading operation mode during a stick excavation operation in accordance with various disclosed embodiments.
Figure 5:
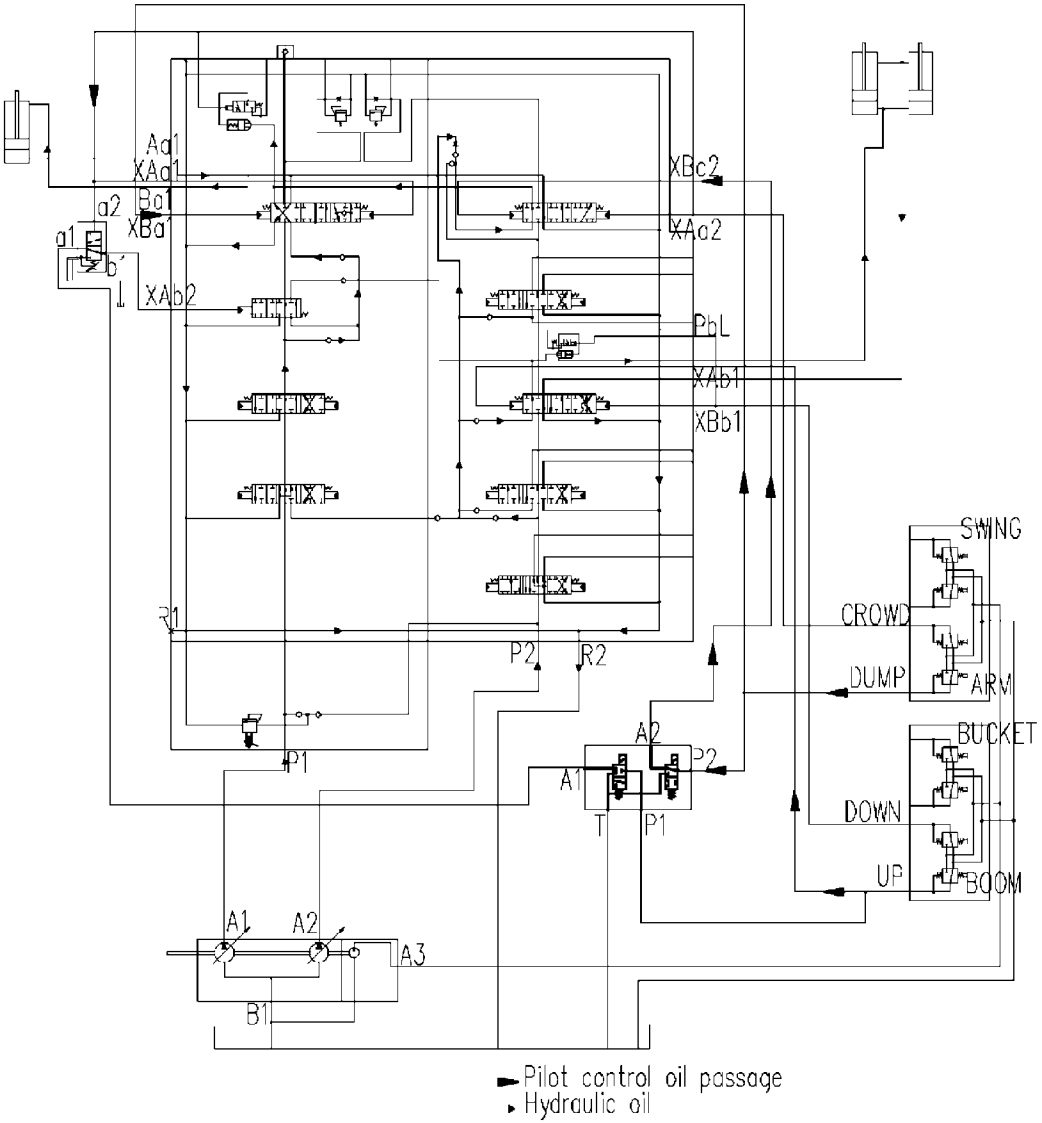
FIG. 5 is a schematic diagram illustrating flow directions of hydraulic oil passages in a grading operation mode during a stick swing operation in accordance with various disclosed embodiments.

In a second embodiment, as illustrated in FIGS. 1, 4 and 5, when in a 'grading operation mode,' after the solenoid valve group 4 receives a change-direction command, the valve spool changes direction.

When performing a combined action operation of boom lifting and stick excavating, the right control lever valve 5 is controlled to cause the boom lifting pilot control circuit to be connected. Hydraulic oil enters the right control lever valve 5 from the hydraulic oil tank 3 via the gear pump 2 and thereafter reaches the control end XAb1 of the multiplexer valve group 8 via the BOOM UP end. After the valve spool changes direction, the P2 hydraulic oil of the double hydraulic pump 1 independently supplies oil to achieve boom lifting (boom cylinder 10 extends out). Hydraulic oil in the rod chamber of the boom cylinder 10 flows back via the multiplexer valve group 8 and, thereafter, returns to the hydraulic oil tank 3 via the R2 end, forming a complete boom lifting operation circuit.

The left control lever valve 6 is controlled to cause the stick excavation pilot control circuit to be connected. Control oil entering the left control lever valve 6 via the gear pump 2 is connected to the pilot control end XAa2 of the multiplexer valve group 8 via the ARM CROWD end to cause a remaining flow of the P2 hydraulic oil of the double hydraulic pump 1 to be supplied to a stick adduction operation (stick cylinder 9 extends out). Control oil of the left control lever valve 6 of another channel is connected to the pilot control end XAa1 of the multiplexer valve group 8 via the ARM CROWD end and pushes the valve spool in the multiplexer valve group 8 to change direction to cause all of the P1 hydraulic oil of the double hydraulic pump 1 to participate in the stick adduction operation. A portion of hydraulic oil in the rod chamber of the stick cylinder 9 participates in confluence of the P1 hydraulic oil and the P2 hydraulic oil via the 'hydraulic oil recovery circuit' in the multiplexer valve group 8 and another portion returns to the hydraulic oil tank 3 via the oil return channel in the multiplexer valve group 8. Thereby, a complete stick excavation operation circuit is formed.

When performing a combined action operation of boom lifting and stick swinging, the right control lever valve 5 is controlled to cause the boom lifting pilot control circuit to be connected. Hydraulic oil enters the right control lever valve 5 from the hydraulic oil tank 3 via the gear pump 2 and thereafter reaches the control end XAb1 of the multiplexer valve group 8 via the BOOM UP end. After the valve spool changes direction, the P2 hydraulic oil of the double hydraulic pump 1 independently supplies oil to achieve boom lifting (boom cylinder 10 extends out). Hydraulic oil in a rod chamber of the boom cylinder 10 flows back via the multiplexer valve group 8 and, thereafter, returns to the hydraulic oil tank 3 via an oil return port R2, forming a complete boom lifting operation circuit.

The left control lever valve 6 is controlled to cause a stick swinging pilot control circuit to be connected. Control oil entering the left control lever valve 6 via the gear pump 2 is connected to a pilot control end XBa1 of the multiplexer valve group 8 via the ARM DUMP end. The valve spool is controlled to change direction to cause all of the P1 hydraulic oil of the double hydraulic pump to be supplied to a stick swinging (that is, recovery of a piston rod of the stick cylinder 9) circuit. The control oil of the left control lever valve 6 is connected to a pilot control end XBa2 of the multiplexer valve group 8 via another channel of the ARM DUMP end and then via the control oil input end P2 of the solenoid valve group 4.

The valve spool of the multiplexer valve group 8 changes direction to cause a remaining flow of the P2 hydraulic oil of the double hydraulic pump 1 to merge with the P1 hydraulic oil and then to be supplied to a stick swinging operation (recovery of the stick cylinder 9). Hydraulic oil in a rodless chamber of the stick cylinder 9 returns to the hydraulic oil tank 3 via the oil return port R2 of the multiplexer valve group 8. Thereby, a complete circuit is formed. Since double pump confluence is achieved for the stick swinging operation, the flow rate is increased.

Stick swinging speed is significantly better than that of using a single pump and can meet requirement for fast stick swinging back and forth during a land grading operation, and thus improves the operation efficiency of the stick during a land grading operation. Since the boom lifting confluence is disconnected and is replaced by using a single pump (SP) (as shown in FIG. 1) to supply oil, the boom flow impact is relatively small, operation is smooth, and operator comfortability is also greatly improved.

Other applications, advantages, alternations, modifications, or equivalents to the disclosed embodiments are obvious to those skilled in the art.

What is claimed is:

1. A method for improving excavating operation characteristic and grading operation characteristic of an excavator including a boom, a stick and a bucket, the method comprising:

adding a hydraulically controlled selector valve (7) to a boom confluence control circuit for controlling the boom in a hydraulic excavator;

adding a solenoid valve group (4) to control both the boom confluence control circuit and a stick confluence control circuit; and when the solenoid valve group (4) receives a control signal, performing a switching between a disconnected mode and a connected mode of the solenoid valve group (4) such that the excavator switches between an excavation operation and a grading operation;

wherein, based on the control signal, the solenoid valve group (4) is in the disconnected mode to restore a boom lifting confluence circuit, and to disconnect a stick swinging confluence circuit to perform the excavation operation; or wherein, based on the control signal, the solenoid valve group (4) is in the connected mode to disconnect the boom lifting confluence circuit and to restore the stick swinging confluence circuit to perform the grading operation.

2. The method of claim 1, wherein:

in the excavation operation, a pressure sensing end of the hydraulically controlled selector valve (7) detects a control pressure signal of a stick excavation; and when a control pressure value of the stick excavation is smaller than a change-direction pressure of the hydraulically controlled selector valve (7), the hydraulically controlled selector valve (7) does not change direction such that:

a pilot control oil passage controls a boom cylinder (10) and a stick cylinder (9), and hydraulic oil is entirely supplied by a double pump confluence corresponding to a double pump confluence circuit.

3. The method of claim 2, wherein, when the control pressure value of the stick excavation reaches the change-direction pressure of the hydraulically controlled selector valve (7), the hydraulically controlled selector valve (7) changes direction to disconnect the boom confluence control circuit and to independently supply oil to the boom by a single pump, while the double pump confluence circuit is used for stick excavation.

4. The method of claim 1, wherein, in the grading operation, an electrical signal controlling end of the solenoid valve group (4) receives a change-direction command.

5. The method of claim 1, wherein, after receiving the change-direction command, the solenoid valve group (4) changes direction, a pilot control oil passage changes allocation of a double pump confluence, the boom confluence control circuit of boom lifting hydraulic oil is disconnected and is replaced by using a single pump to supply oil to the boom, the stick excavation uses the double pump confluence, and a hydraulic oil passage of stick swinging is connected to be the double pump confluence.

6. The method of claim 1, wherein the change-direction pressure of the hydraulically controlled selector valve (7) is adjusted by a pressure adjustment spring inside the hydraulically controlled selector valve (7).

7. A method for improving excavating operation characteristic and grading operation characteristic of an excavator including a boom, a stick and a bucket, the method comprising:

receiving a control signal by a solenoid valve group (4) that controls both a boom confluence control circuit and a stick confluence control circuit for controlling a confluence for the stick, such that: the solenoid valve group (4) switches between a disconnected mode and a connected mode, and the excavator switches between an excavation operation and a grading operation;

performing the excavation operation, when the solenoid valve group (4) is in the disconnected mode to restore a boom lifting confluence circuit, and to disconnect a stick swinging confluence circuit;

detecting a control pressure value of a stick excavation by a hydraulically controlled selector valve (7) configured in the boom confluence control circuit for controlling the boom of the excavator; and when the control pressure value of the stick excavation reaches a change-direction pressure of the hydraulically controlled selector valve (7) to change a direction, disconnecting the boom confluence control circuit but independently supplying oil to the boom by an additional single pump, while the double pump confluence circuit is only used for the stick excavation.

8. The method of claim 7, wherein:

when a control pressure value of the stick excavation is smaller than the change-direction pressure of the hydraulically controlled selector valve (7), the hydraulically controlled selector valve (7) does not change direction such that:

a pilot control oil passage controls a boom cylinder (10) and a stick cylinder (9), and hydraulic oil is entirely supplied by a double pump confluence corresponding to the double pump confluence circuit.

9. The method of claim 7, further including:

performing the grading operation, when the solenoid valve group (4) is in the connected mode to disconnect the boom lifting confluence circuit and to restore the stick swinging confluence circuit.

10. The method of claim 9, wherein, when performing the grading operation, an electrical signal controlling end of the solenoid valve group (4) receives a change-direction command.

11. The method of claim 10, wherein, after receiving the change-direction command, the solenoid valve group (4) changes a direction such that:

a pilot control oil passage changes allocation of a double pump confluence, the boom confluence control circuit of boom lifting hydraulic oil is disconnected and is replaced by using an additional single pump to supply oil to the boom, the stick excavation uses the double pump confluence, and a hydraulic oil passage of swinging the stick is connected to be the double pump confluence.

12. The method of claim 7, wherein the change-direction pressure of the hydraulically controlled selector valve (7) is adjusted by a pressure adjustment spring inside the hydraulically controlled selector valve (7).

* * * * *